US005714186A

United States Patent [19]

Nash et al.

[11] Patent Number: 5,714,186

[45] Date of Patent: Feb. 3, 1998

[54] BEVERAGE ENHANCER

[75] Inventors: Stuart Justin Nash, Cambridge; Peter John Houzego, Oakington; Timothy Michael Wood, Royston; Peter Erich Cox, Cherry Hinton, all of United Kingdom

[73] Assignee: Scottish & Newcastle, Edinburgh, United Kingdom

[21] Appl. No.: 581,550

[22] PCT Filed: Aug. 1, 1994

[86] PCT No.: PCT/GB94/01660

§ 371 Date: Jan. 4, 1996

§ 102(e) Date: Jan. 4, 1996

[87] PCT Pub. No.: WO95/03983

PCT Pub. Date: Feb. 9, 1995

[30] Foreign Application Priority Data

| | | | |
|---|---|---|---|
| Jul. 30, 1993 | [GB] | United Kingdom | 9315830 |
| Aug. 5, 1993 | [GB] | United Kingdom | 9316197 |
| Aug. 14, 1993 | [GB] | United Kingdom | 9316964 |

[51] Int. Cl.[6] ..... B65D 47/00; B65D 83/00

[52] U.S. Cl. ..... 426/106; 426/112; 426/115; 426/132; 426/398; 426/477; 53/420; 53/432; 53/474; 220/528; 220/906

[58] Field of Search ..... 426/106, 112, 426/115, 124, 131, 397, 398, 394, 474, 477; 53/420, 432, 433, 471, 474; 220/906, 528

[56] References Cited

U.S. PATENT DOCUMENTS

| | | | |
|---|---|---|---|
| 4,524,078 | 6/1985 | Bardsley et al. | 426/112 |
| 4,995,533 | 2/1991 | Vandoninick | 222/54 |
| 5,584,165 | 12/1996 | Wright | 53/432 |

FOREIGN PATENT DOCUMENTS

| | | |
|---|---|---|
| 0 227 213 | 7/1987 | European Pat. Off. . |
| 0 448 200 | 9/1991 | European Pat. Off. . |
| WO 91/07326 | 5/1991 | WIPO . |

*Primary Examiner*—Donald E. Czaja
*Assistant Examiner*—Curtis E. Sherrer
*Attorney, Agent, or Firm*—Lee, Mann, Smith, McWilliams, Sweeney & Ohlson

[57] ABSTRACT

A device for generating a head on a beverage in a sealed can, when the can is opened, comprising a hollow capsule with first and second compartments communicating via tubes with apertures respective each on the opposite side of the capsule from the side of the chamber with which the tube communicates, and a ballast means for orientating the capsule in a position such that, as one chamber charges with liquid, the capsule is caused to rotate and trap a volume of air therein. The capsule may be cylindrical or more preferably spherical in external shape.

24 Claims, 6 Drawing Sheets

BEVERAGE ENHANCER

FIELD OF INVENTION

This invention concerns devices for assisting in the production of a so-called head on an alcoholic beverage such as beer, ale, stout or lager.

BACKGROUND TO THE INVENTION

EP 0520646A1 describes a hollow capsule device which can be inserted into and fixed at the bottom of a can which is to contain a beverage, the latter being pressurised by an inert gas when the can is sealed, typically Nitrogen. The gas occupies a headspace above the beverage in the can and by inverting the can shortly after the contents are pressurised, the headspace can be transferred to the opposite end of the can containing the said device. By providing a small aperture in the wall of the capsule, through which the gas can pass when the can is inverted, the interior of the capsule can be raised to the headspace pressure and by selecting the position of the aperture, the gas which has entered the capsule can be trapped therein when the can is returned to its normal upright position.

As described in EP 0520646A1 before the can is inverted the aperture in the wall of the capsule will enable beverage to be forced into the capsule therethrough as the can contents rise in pressure.

Beverage will continue to be forced into the capsule until the pressure inside the capsule balances the pressure within the can—unless the can is inverted before this process is complete, after which, instead of beverage entering the capsule, gas from the headspace will be forced into the capsule until the pressure balance is obtained.

In general it is desirable that the capsule should contain as much gas as possible, rather than beverage, and it is for this reason that the can should be inverted as soon as possible after sealing and pressurisation of the can contents begins to occur.

It has been known for many years to invert pressurised beverage cans between filling and pasturisation for a completely different purpose—namely to allow for lid seal verification by simply checking the level of the beverage in the can after pasturisation. Since the latter involves raising the temperature of the can and its contents by an appreciable amount, and therefore the internal pressure in the can as a consequence. Any weakness in the lid seal will tend to be revealed by this process and if the seal is not perfect, some of the contents of the can will be forced out through the imperfection in the seal. If the can is inverted it will be beverage which will be forced out by this process and this will result in a smaller volume of beverage in the can than would have been the case. If as is usual, the volume of beverage in the can is accurately controlled during the filling operation, the level of beverage in each filled can should be the same, and by checking the level after pasturisation, cans having a lower than permitted level of beverage can be identified readily and rejected.

However the need to invert the cans very quickly after sealing requires a canning line to be modified, since existing canning lines do not normally provide for can inversion until shortly before entering into the pasturizer and this could be an appreciable distance away from the can filling and sealing apparatus.

Furthermore, although canning lines are intended to operate continuously, stoppages do occur due for example to faulty cans, cans falling over and cans becoming jammed. If the time within which a can is to be inverted is limited to a few seconds, all the cans which have been sealed but not completely inverted just before a shutdown of the line should be rejected since too much beverage will have entered the capsule before the can is finally inverted when the line begins operating again.

It is an object of the present invention to provide a new design of capsule which can still be pressurized by gas from the headspace but which does not require the can to be inverted before it will be so pressurized.

SUMMARY OF THE INVENTION

According to the present invention, in its broadest aspect a head generating device comprises a substantially hollow capsule having a first aperture, a second aperture remote from the first aperture, the capsule being such the it will float in a liquid with the first aperture above the liquid surface and the other immersed, wherein liquid can enter the capsule through the immersed aperture, the mass of liquid entering the capsule acting to cause the capsule to rotate at least to the extent that the respective conditions of the two apertures are reversed and the interior of the capsule forming with the liquid therein a liquid lock when the latter is rotated to inhibit the further ingress of liquid and trap a volume of gas therein.

If such a device is located within a sealed and pressurised container which is partially filled with liquid, the interior of the capsule will be pressurised by gas in the headspace above the liquid to the same elevated pressure as that of the headspace. After it at least partially inverts, the trapped gas remains at the elevated pressure and is available to exit from the capsule when the container is opened and the pressure in the container drops.

Where the liquid contains dissolved gas such as nitrogen and carbon dioxide and the issuing gas has to pass through the liquid before it can escape to atmosphere, the issuing gas can be arranged to initiate an avalanche effect on the dissolved gases and create a head of fine bubbles on the liquid.

Generally it is necessary for the issuing gas to be in the form of a fine jet to achieve significant head production to which end the size of the aperture through which gas is to issue into the liquid is selected so as to create such a desired jet.

Most preferably, the initial floating condition of the capsule is determined by ballast means forming part of or carried by the capsule. Generally the ballast means will be of appropriately selected mass, and position (with respect to the capsule), to ensure a chosen initial floating condition of the capsule.

The ballast means is most preferably fixed in position on or within the capsule.

According to a preferred aspect of the present invention, a device for enhancing the so-called head formation on a beverage when the latter is poured from a can shortly after the can has been broached thereby relieving the headspace pressure to atmospheric comprises:

(1) a hollow capsule divided internally into two chambers, (2) a first aperture in the capsule wall communicating with one of the two chambers, (3) a second aperture in the capsule wall communicating with the second of the two chambers, (4) a venting aperture in the capsule wall also communicating with the said second chamber, and wherein (5) the buoyancy of the capsule is selected so that it will float in the beverage with approximately one half its volume submerged below the surface of the beverage and so that the said first aperture and the venting aperture are above the surface of the beverage and the said second aperture is below the surface, so that the second chamber will fill with beverage and the first chamber will be pressurised with gas at whatever pressure exists above the surface of the beverage, and wherein the position of the second chamber within the capsule is such that as it fills with beverage the device is caused to rotate so that the first aperture becomes immersed and the gas in the first chamber is trapped therein.

Upon broaching a can containing such a device to atmospheric pressure, the trapped gas will be at a higher pressure than atmospheric and will leave the capsule through the said first aperture which being immersed, will cause the rising gas to pass through the beverage thereby disturbing the beverage and in known manner cause dissolved gases therein to come out of solution and form a head of bubbles on the surface of the beverage in the can.

The volume of the second chamber may be such that when at least partially filled with beverage, the buoyancy of the capsule is reduced to such an extent that it will submerge and sink to the bottom of the can.

The chamber of trapped gas in the capsule will maintain the orientation of the capsule such that the first chamber is always above the second chamber. By positioning the aperture in the capsule wall through which the gas can escape when the can is broached so that this is generally opposite to the region of the capsule containing the chamber filled with gas, so the gas emitting aperture will be located on the underside of the capsule.

Provided the capsule is free to rotate in the beverage within the can even if submerged, it will always maintain the same attitude (with the first chamber uppermost and the beverage filled chamber lowermost) whatever the attitude of the can.

Inversion of the can whether for pasturisation or otherwise, such as when stored on a shelf or in a refrigerator, will not affect the can orientation thereby ensuring that the gas remains trapped in the first chamber of the capsule until required.

Preferably the first aperture is connected to the first chamber by means of an elongate tube which may extend through the said second chamber.

Conveniently the second chamber also communicates with one of the two apertures serving the second chamber by a similar elongate tube which may extend through the said first chamber.

In order that the second chamber can become completely filled with beverage, a third aperture may be required connecting with the second chamber so that there is always one aperture through which the second chamber can vent to the headspace whatever the rotational position of the device.

The size of the first aperture will determine the time taken for the first chamber to pressurise and the time taken for the charge of trapped gas to issue into the beverage when the can is broached. Its size should however be selected so that the force and duration of the gas jet into the liquid is sufficient to cause the desired head to be produced on the beverage.

The size of the apertures communicating with the second chamber will determine the time for the latter to fill with beverage and should be selected accordingly.

Where pressurization of the can is achieved by so-called liquid Nitrogen dosing the internal pressure will be achieved very quickly after the can has been sealed. However, in order to ensure that it is only gas which enters the first chamber, it is preferable for the can to remain upright on the canning line for a sufficient length of time after sealing and before inversion, for the internal can pressure to become stabilised and in this event the can inversion step is preferably deliberately delayed for a period of typically 10 seconds or more to ensure this has occurred. In this way the pressure in the first chamber will be at the headspace pressure before the capsule is submerged as the can is inverted.

Since the ingress of beverage into the second chamber will also determine how long the capsule remains with the first aperture above the surface of the beverage, the size of the second aperture and/or venting aperture may be related so as to cause rotation of the capsule to occur before or after can inversion depending on the time for rotation due to beverage ingress and the time between sealing and inversion.

Once the capsule has rotated so that the first aperture is below the surface further increases in can pressure can drive beverage into the said first chamber.

If as is normally the case, it is desirable that any beverage which enters the first chamber should not be ejected instead of the trapped gas (other than any beverage in the aperture of the first chamber), a liquid lock is preferably provided where the first aperture communicates with the first chamber so that any beverage which enters the first chamber will be prevented from leaving the chamber ahead of the gas trapped therein, when the can is broached. Where the first aperture communicates with the first chamber via a tube, a liquid lock is most simply formed by extending the tube into the first chamber to a position in the first chamber remote from the internal division between the first and second chambers so that when the latter is filled with beverage and the capsule has rotated so that it is lowermost, the open end of the tube extending into the first chamber from the first aperture, will be high up in the first chamber and will normally be above the level of any beverage which might be forced into the first chamber through the said tube.

Since the first chamber is separated from the second chamber into which beverage flows to alter the buoyancy of the capsule, the volume of beverage entering the capsule for this purpose does not affect the volume available for trapping gas.

The capsule may be cylindrically shaped with the apertures in the cylindrical wall and the internal division extending generally axially or more preferably it is generally spherical in shape.

The invention also lies in an improved filling line and canning line as described herein in which the capsules are spherical and are removed from the bulk using a hopper and drop feed to the cans, the capsules having been purged and maintained under a Nitrogen blanket whilst awaiting insertion into the cans.

The invention will now be described by way of example, with reference to the accompanying drawings in which.

DETAILED DESCRIPTION OF THE DRAWINGS

Although illustrated and described as a cylindrical device it is to be understood that the capsule may be any shape and is preferably spherical like a ping-pong ball to facilitate handling before insertion into the cans and to prevent it becoming jammed in the can.

Figure 1:
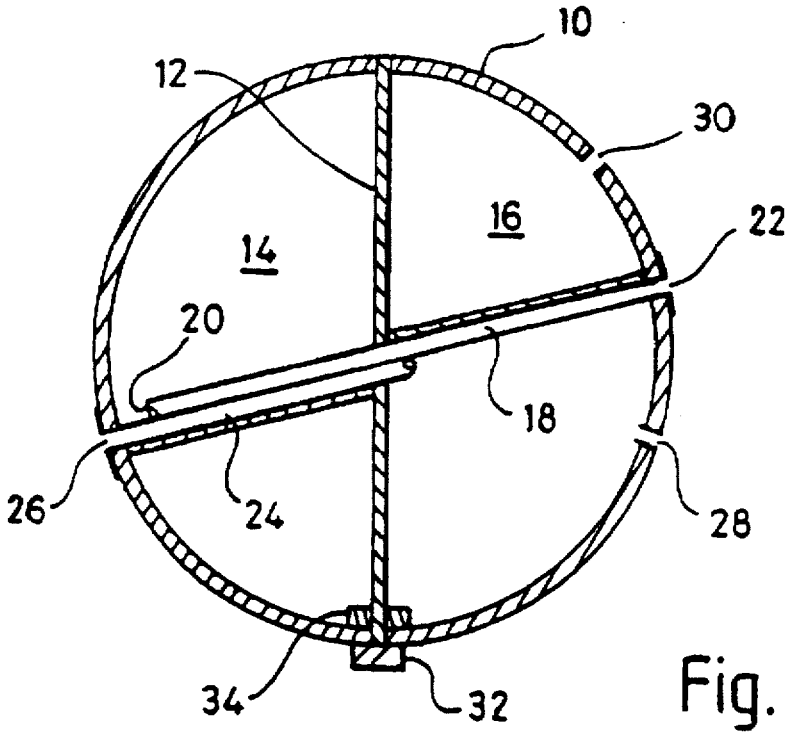
FIG. 1 is a cross section through a capsule constructed as one embodiment of the invention.

FIG. 1 of the drawings is a cross-section through a cylindrical capsule the ends of which are closed so as to define an enclosed cylindrical volume. The cylindrical wall is denoted by reference numeral 10 and the interior is divided by a partition wall 12 into two compartments 14 and 16. The compartment 14 communicates with the outside of the capsule via a tube 18 which protrudes through the partition wall and is open at one end 20 close to the inside surface of the cylindrical wall 10 and is sealed to the outside wall 10 at its other end so as to communicate with a small hole 22 having a diameter in the range 150–300 microns. Communication between the chamber 14 and the outside of the cylinder 10 is therefore achieved through the tube 18 and the hole 22.

Gas or liquid can pass in either direction.

In a similar manner the compartment 16 communicates with the exterior of the cylindrical capsule 10 through a second tube 24 which communicates with another hole in the wall 10 at 26 typically somewhat larger in diameter than the very small hole at 22. As with the tube 18, the tube 24 also extends through the partition wall 12 but does not need to extend beyond the partition wall 12 in the same way as the tube 18 extends into the compartment 14.

The compartment 16 also communicates via one or more other holes similar in size to the hole 26 as denoted at 28 and 30.

A weight 32 is attached to the cylindrical capsule.

Figure 2:
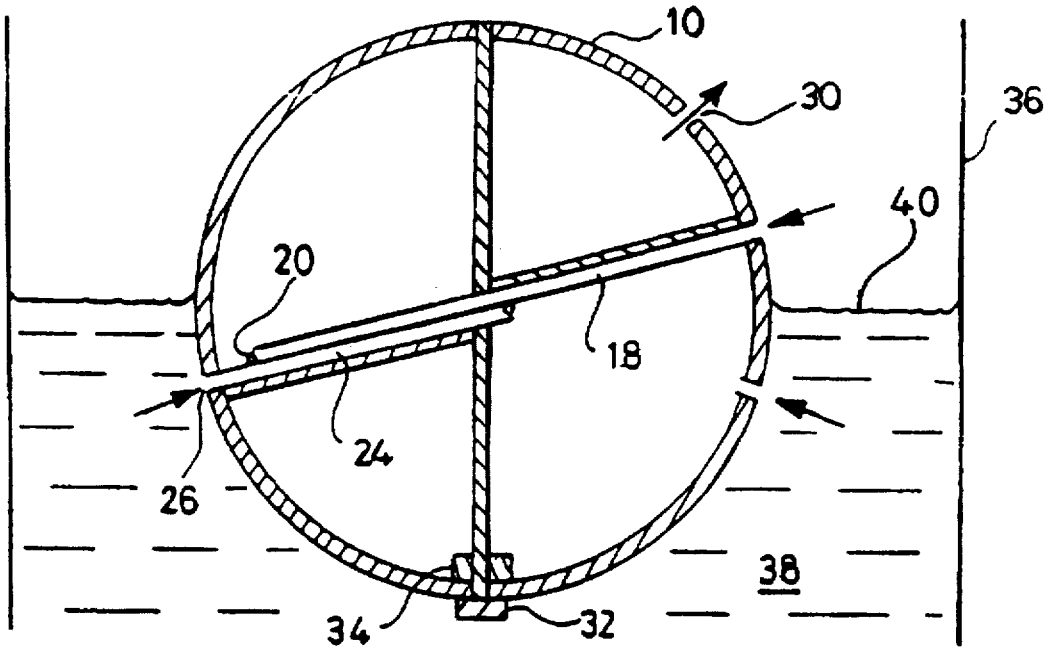
FIG. 2 is a similar view showing the capsule floating in beer in a can just after the latter has been filled and sealed and pressure is building up in the headspace.

If the capsule is merely intended to float on the surface of the liquid, the weight may be affixed to the interior or the exterior of the cylinder so as to act as a ballast and orientate the cylinder so that it floats in the manner shown in FIG. 2.

If the cylindrical capsule is intended to sink then the weight is more conveniently attached to a yoke which pivots about the central axis of the cylinder from pivot points at the centre of each end so that as the cylinder rotates, the weight is always at the lowest point of the circular cross-section of the cylinder. Since the weight is intended to orientate the cylinder so that the latter occupies the position shown in FIG. 2 relative to the surface of a liquid into which it is placed, the cylinder itself preferably includes an internal weight shown at 34 serving to ensure that the cylinder 10 adopts the position shown in FIG. 2 when it is first dropped into a liquid.

FIGS. 2 onwards show the device of FIG. 1 at different positions within a beer can 36 which has been partially filled with beer 38 to a level 40. If the can is sealed with a headspace above the surface 40 containing liquid Nitrogen, it will become pressurised, typically to a pressure of 4 to 6 bar, as the liquid nitrogen evaporates. The gas above the surface 40 will therefore pressurise the compartment 14 via the tube 18 and will also pressurise compartment 16 via the aperture 30.

Since the gas pressure in the headspace will also act on the liquid surface 40, the pressures above and below the surface will be balanced. As a result of hydrostatic pressure, beer will begin to enter compartment 16 via hole 28 and tube 24 via aperture 26. Gas within compartment 16 will be vented through aperture 30.

Since aperture 22 is above the surface of the liquid 40, only gas will enter compartment 14.

In view of the partition 12, liquid entering the capsule will be constrained into one segment of the capsule and the capsule will begin to rotate about its axis due to the turning moment exerted by the weight of the liquid on the right hand side 14 of the partition wall as shown in the drawing.

Figure 3:
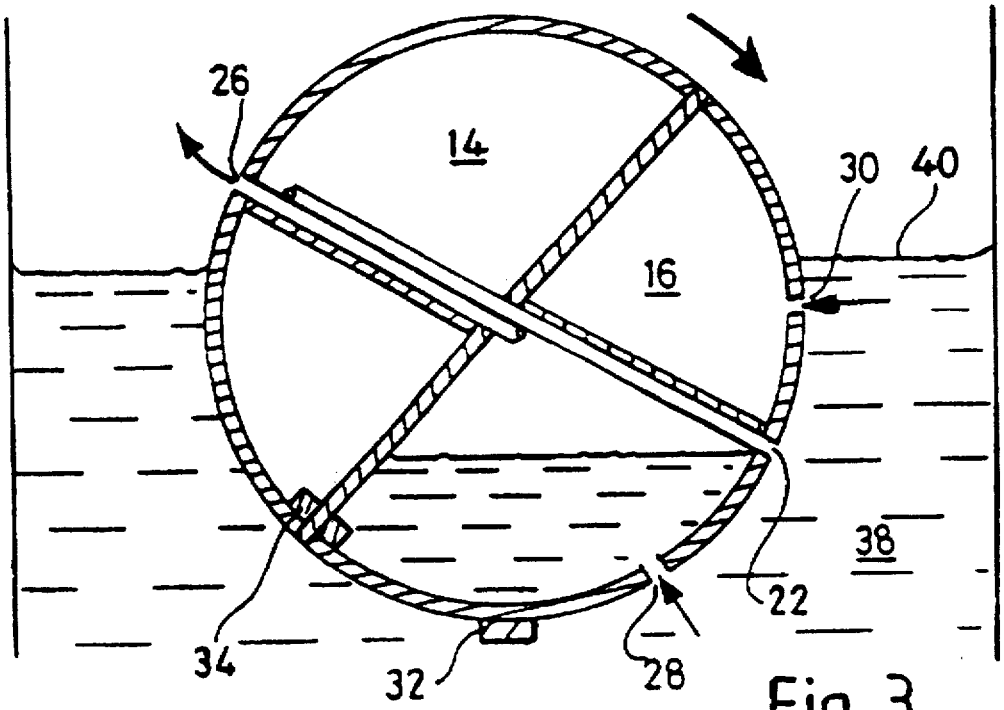
FIG. 3 shows the capsule some time later after beer has partially filled the lower chamber in the capsule.
Figure 4:
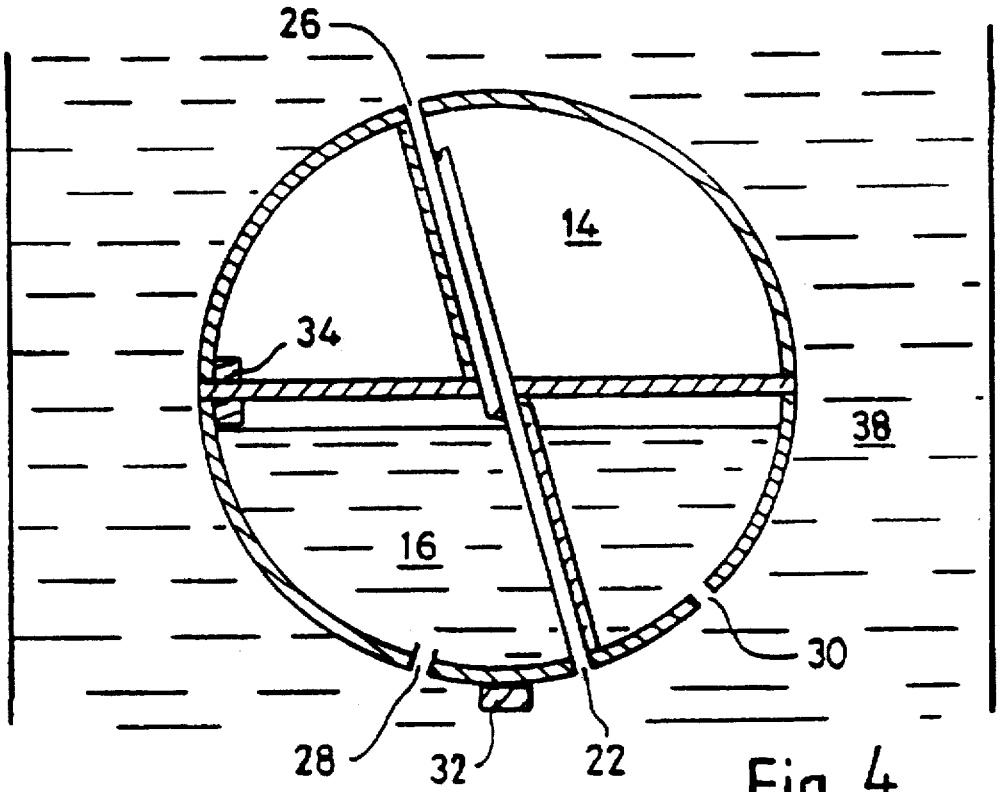
FIG. 4 shows the capsule after the lower chamber has been sufficiently filled with beer to cause the device to sink.

FIG. 3 shows one such intermediate position.

Rotation of the cylindrical capsule will of course cause the entrance 22 to go below the surface 40, but since this will mean the upper end of the tube 18 will have risen above the level of the surface 40, there will be little tendency for liquid to enter the tube 18 and there is no tendency for the gas trapped within the compartment 14 to leave.

Continued ingress of beer will eventually cause the lower half of the cylinder to become entirely full. The combined effect of the weight 32, the weight 34 and the beer in the lower compartment 16 can be arranged to cause the capsule to either settle relative to the surface or actually submerge.

On broaching the can, the air trapped in the compartment 14 will exit rapidly through the tube 18 and small hole 22 so as to cause an avalanche of bubbles to rise to the surface of the can and form a head which remains on the beer when it is poured into a drinking vessel.

Although described as a cylindrical vessel, the capsule may of course be any other shape suitable for rotational movement within the liquid and may to advantage be spherical to assist in handling before they are introduced into the cans.

Figure 5:
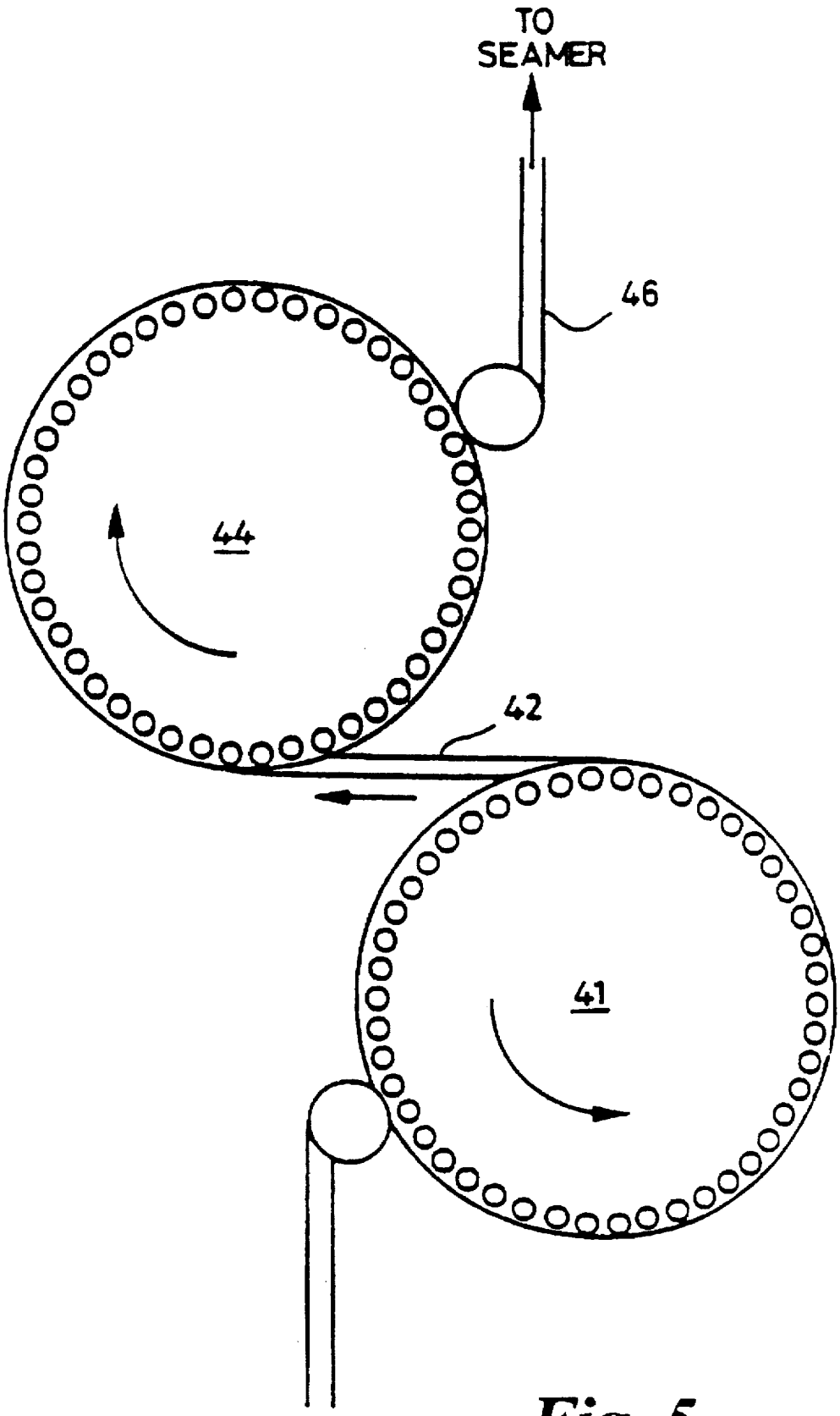
FIG. 5 is a diagrammatic plan view illustrating how a can filling carousel can be followed by a capsule inserting carousel.

In the diagrammatic plan view of FIG. 5 containers exiting a filler carousel 41 along line 42 pass directly into a second carousel 44 where capsules are inserted into the containers. These leave carousel 44 on path 46 to a seamer (not shown) where the can is dosed with liquid nitrogen and the lid is affixed and sealed in place.

Figure 6:
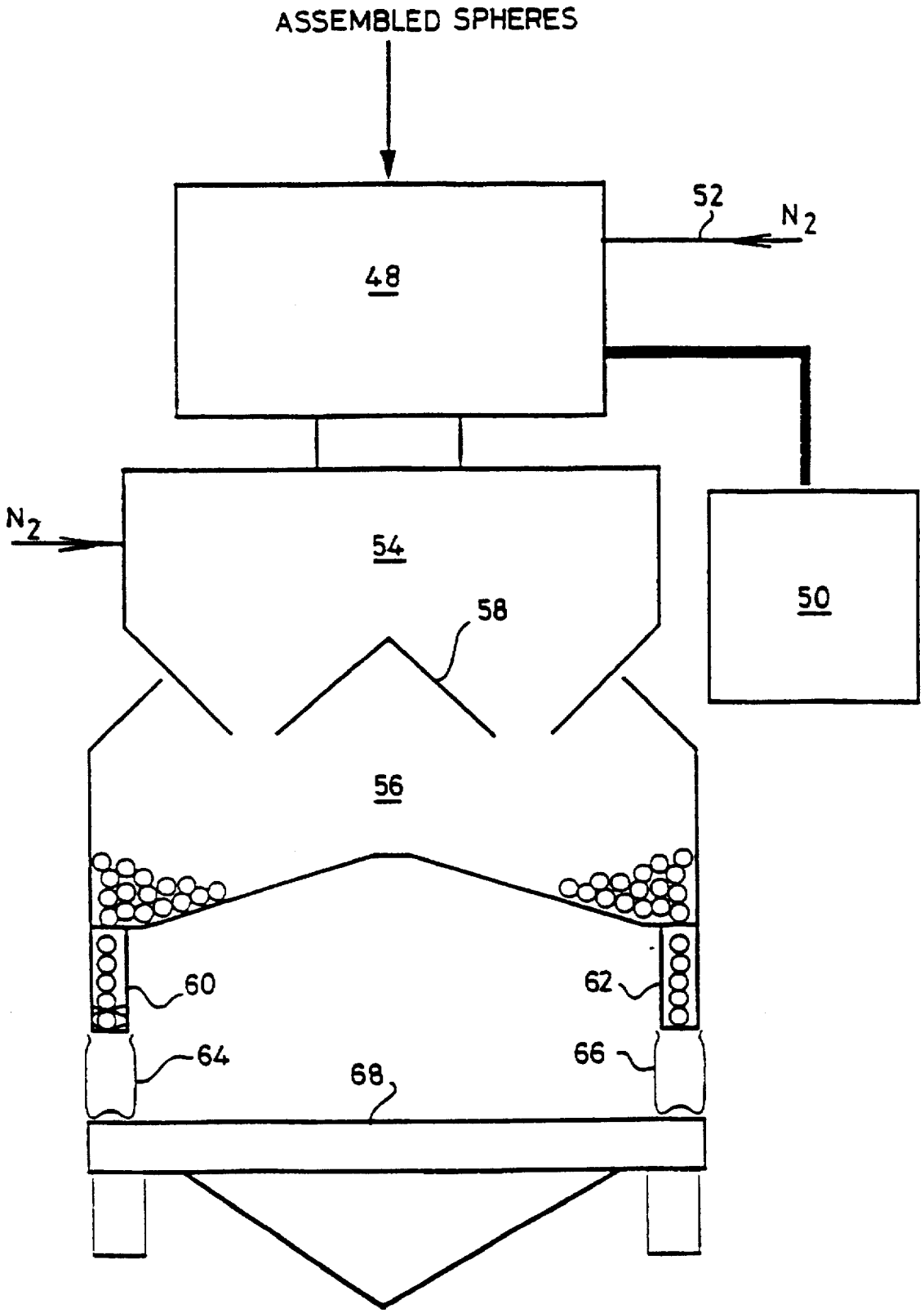
FIG. 6 illustrates how spherical capsules can be handled prior to insertion into cans.

FIG. 6 illustrates how a capsule filling carousel such as 44 can be fed with spherical capsules.

A purge chamber 48 is supplied with assembled spherical capsules. When filled, the purge chamber is sealed and evacuated using a vacuum pump 50. After evacuation, the chamber is filled with nitrogen from a suitable supply along line 52 so that the capsules are now in a nitrogen environment and the interiors will be filled with nitrogen.

The contents of the purge chamber 48 can be transferred to a holding tank 54 when required so that a fresh purging process can be carried out on a fresh batch of capsules.

The holding tank 54 is supplied with nitrogen at a pressure slightly in excess of atmospheric and periodically capsules in the holding tank are transferred to the filler dispenser 56 by lowering a bell valve 58. A similar device (bell valve) is used for transferring capsules between the purge chamber and the holding tank.

Capsules in the filler dispenser 56 are maintained in a nitrogen atmosphere thereby preserving atmospheric integrity and from the filler dispenser 56 are allowed to roll into radially positioned escapement shoots 60 and 62 to be deposited into cans such as 64 and 66. The latter are supported on a lifting table 68. During the filling cycle the system is configured to carry out further purging of the container headspace as by evacuation, purging with nitrogen and liquid nitrogen dosing.

Figure 7:
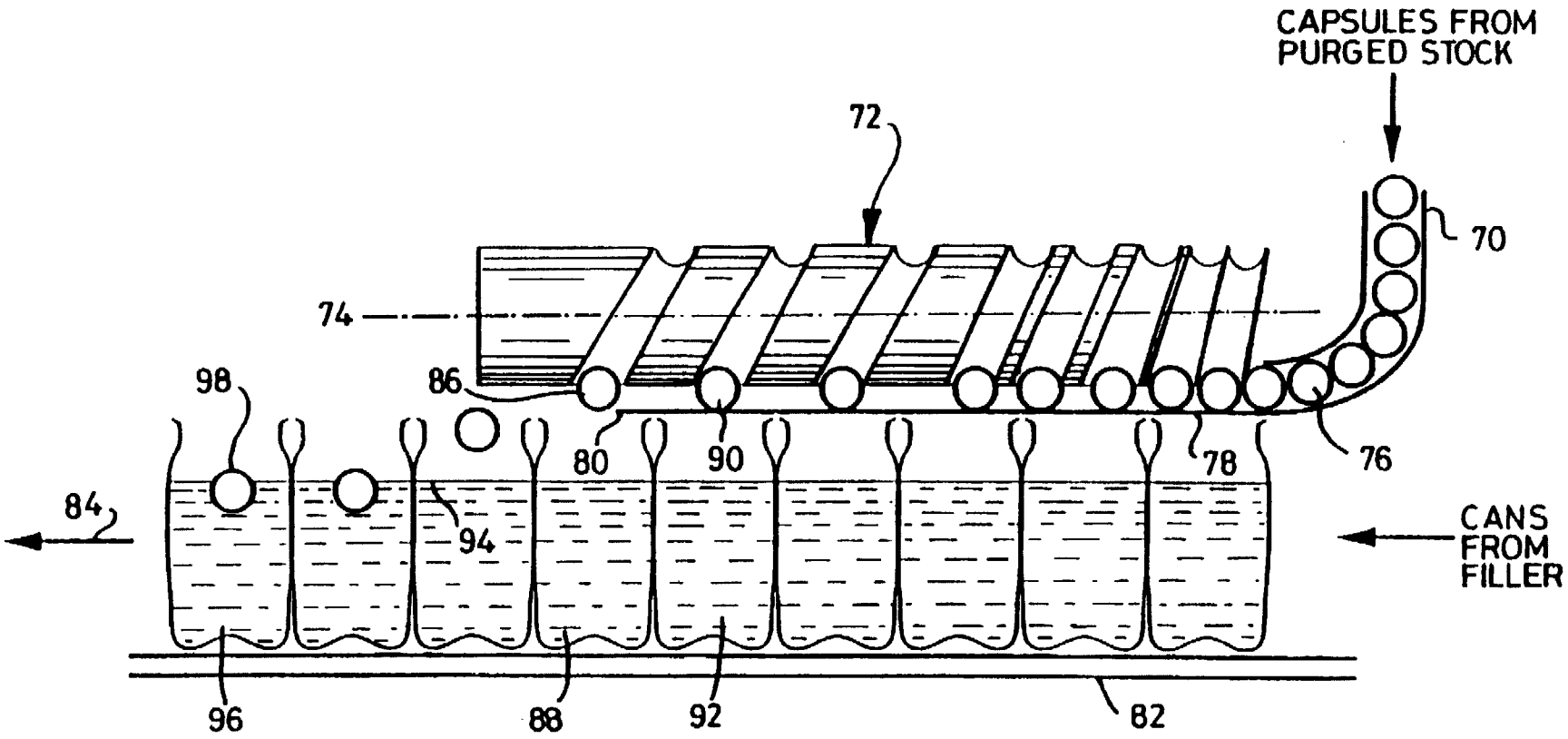
FIG. 7 shows how spherical capsules can be aligned and fed to cans on a filling line.

An alternative arrangement is shown in FIG. 7 in which purged capsules from stock such as the filler dispenser 56 of FIG. 6, are supplied via a feed line 70 to an auger feed generally designated 72. The auger rotates about the axis 74 and the pitch of the auger varies along the axial length of the feed so that capsules such as 76 are captured by the auger and separated and spaced apart with movement along the table 78 until they reach the drop-off point 80. The latter is situated above a conveyor 82 on which cans are located and the conveyor and line of cans moves in the direction of the arrow 84 and is synchronised with the movement of the auger feed 72 so that capsules arrive at the drop-off point in synchronism with the arrival of the next empty can below the drop-off point 80. Thus capsule 86 is shown just about to drop into can 88.

By synchronising the movement, the next capsule 90 will arrive at the drop-off point 80 when can 92 arrives below the point 80. In this way capsules are separated and fed individually to the cans.

Each of the cans has previously been filled with beverage and the level of the beverage in the cans is denoted by reference numeral 94. As shown with reference to can 96, the capsule 98 floats in the beverage.

The conveyor 82 moves the line of cans towards the seamer where just prior to the lid being applied to the can, the can is dosed with liquid nitrogen in known manner and thereafter sealed so that the process of gaseous priming of the capsule 98 can be performed as previously described.

Figures 8, 8A:
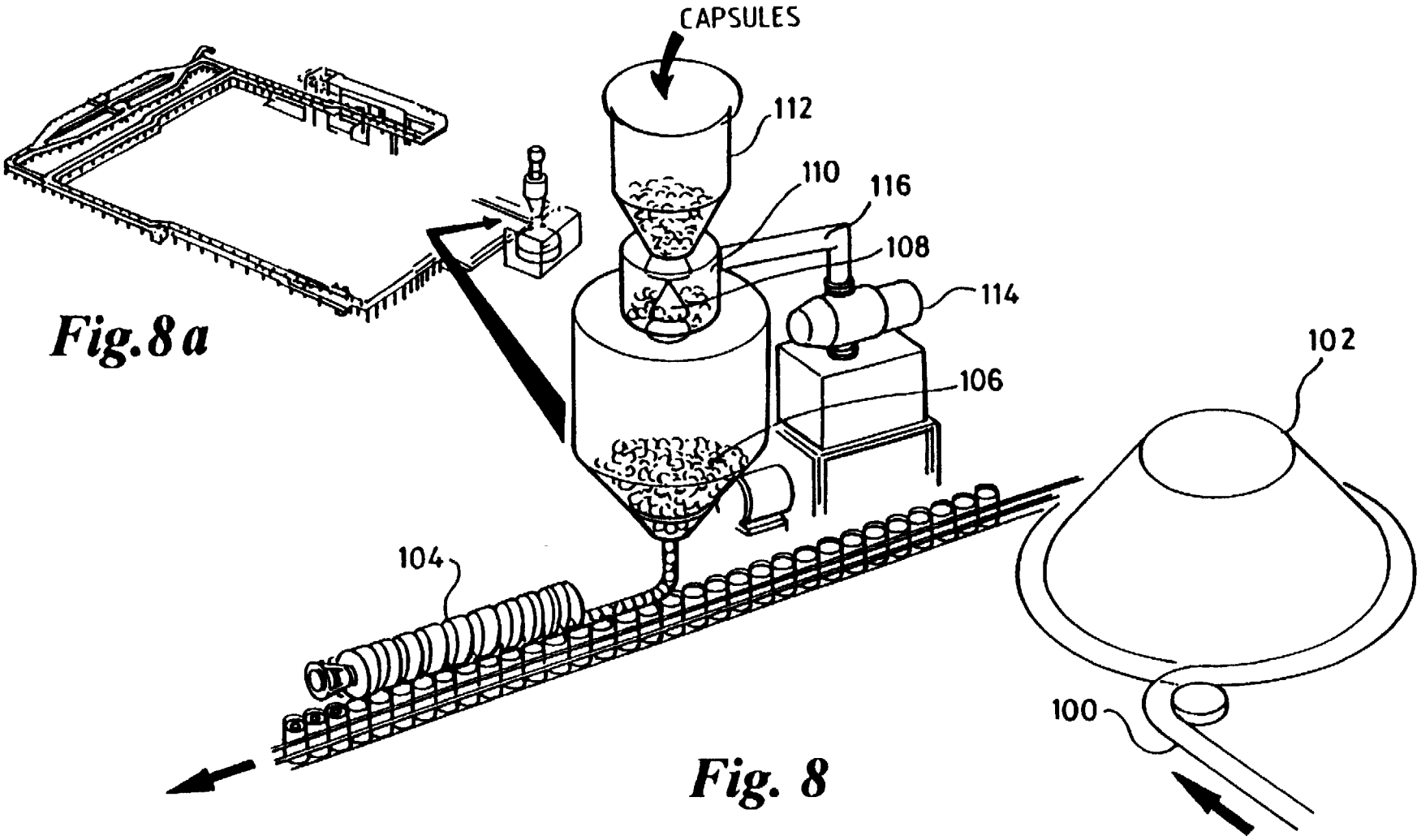
FIG. 8 is a perspective diagrammatic view of a can filling line incorporating the arrangements of FIGS. 6 and 7.
FIG. 8A shows a perspective overview of the can filling line showing the location of a capsule insertion stage.

FIG. 8 illustrates a fully integrated on-line insertion plant. Here the cans are supplied along a conveyor path 100 to a filling carousel 102. Filled cans are supplied to the capsule loading auger 104 fed from the feed hopper 106. A bell valve 108 releases capsules into the hopper 106 from a purge chamber 110 itself fed from a hopper 112.

Capsules supplied to the auger 104 are transferred individually into the cans in the manner previously described in relation to FIG. 7 and the cans are immediately transferred to the seamer (not shown).

A perspective overview of the complete system showing where the capsule insertion stage would be located is shown in FIG. 8*a*.

Also shown in FIG. 8 is the vacuum pump 114 for evacuating the purge chamber 110 via pipe 116. Not shown is the nitrogen input to the purge chamber and feed hopper.

Also now shown is shrouding around the auger 104 so that the auger filling stage can itself be operated in a nitrogen envelope to further maintain the integrity of the purged capsules so that there is little chance of any oxygen entering the capsule and thereby entering the cans.

The headspace is purged in the normal way which may involve evacuation, nitrogen blanketing, nitrogen dosing and the like prior to seaming.

We claim:

1. A device for generating a head on a beverage in a sealed container when the container is opened, comprising a substantially hollow capsule having a first aperture, a second aperture remote from the first aperture, and ballast means forming part of or carried by the capsule, the capsule being such that it will float in a liquid with the first aperture above the liquid surface and the other immersed, wherein liquid can enter the capsule through the immersed aperture, the mass of liquid entering the capsule acting to cause the capsule to rotate at least to the extent that the respective conditions of the two apertures are reversed and the interior of the capsule forming with the liquid therein a liquid lock when the latter is rotated, to inhibit the further ingress of liquid, and trap a volume of gas therein which is available to jet into the beverage when the can is opened.

2. A device according to claim 1, wherein the initial floating condition of the capsule is determined by ballast means (32, 34) forming part of or carried by the capsule.

3. A device according to claim 2, wherein the ballast means (32, 34) is of appropriately selected mass and position to ensure a chosen initial floating condition of the capsule.

4. A device according to claim 2, wherein the ballast means (32, 34) is fixed in position on or within the capsule.

5. A device according to claim 1, located within a sealed and pressurised container (36) which is partially filled with liquid (38), so that the interior of the capsule is pressurised by gas in the headspace above the liquid to the same elevated pressure as that of the headspace and, after the capsule (10) rotates, the trapped gas remains at the elevated pressure and is available to exit from the capsule (10) when the container (36) is opened and the pressure in the container drops.

6. A device according to claim 5, wherein the liquid (38) in the container (36) contains dissolved gas and the issuing gas has to pass through the liquid before it can escape to atmosphere, and wherein the issuing gas is arranged to exit as a jet which initiates an avalanche effect on the dissolved gases to create a head of fine bubbles on the liquid.

7. A device according to claim 6, wherein the size of the aperture (22) through which the gas is to issue into the liquid is selected so as to create a fine jet.

8. A device according to claim 1, wherein the capsule (10) is cylindrical.

9. A device according to claim 1, wherein the capsule (10) is spherical.

10. A device for enhancing head formation on a beverage in a sealed container, when the container is broached, wherein:

(1) the hollow capsule (10) is divided internally into two chambers (14, 16), (2) the first aperture (22) in the capsule wall communicates via the tube (18) with one chamber (14) of the two chambers, (3) the second aperture (26) in the capsule wall communicates with the second chamber (16) of the two chambers, (4) a venting aperture (30) is provided in the capsule wall also communicating with the said second chamber (16), and (5) the buoyancy of the capsule (10) is selected so that it will float in the beverage with a part of its volume submerged below the surface of the beverage and so that the said first aperture (22) and the venting aperture (30) are above the surface of the beverage and the said second aperture (26) is below the surface, whereby the second chamber (16) will fill with beverage and the first chamber (14) will be pressurised with gas at whatever pressure exists above the surface of the beverage, and wherein the position of the second chamber (16) within the capsule is such that as it fills with beverage the capsule (10) is caused to rotate so that the first aperture (22) becomes immersed and the gas in the first chamber (14) is trapped therein.

11. A device according to claim 10, wherein the volume of the second chamber (16) is such that when at least partially filled with beverage, the buoyancy of the capsule (10) is reduced to such an extent that it will submerge and sink to the bottom of the can.

12. A device according to claim 10, wherein the trapped gas in the capsule (10) is arranged to maintain the orientation or the capsule such that the first chamber (14) is above the second chamber (16), so that the aperture (22) in the capsule wall (10) through which the gas can escape when the container (36) is broached (and which is generally opposite to the region of the capsule (10) containing the chamber (14) filled with gas) is located on the underside of the capsule.

13. A device according to claim 10, wherein the elongate tube (18) extends through the said second chamber (16).

14. A device according to claim 13, wherein the second chamber (16) also communicates with one aperture (26) of the apertures (26, 30) serving the second chamber (16) by an elongate tube (24) which extends through the first chamber (14).

15. A device according to claim 10, wherein, in order that the second chamber (16) can become substantially completely filled with beverage, a third aperture (28) is provided connecting with the second chamber (16), so that there is always one aperture of the apertures (26, 28, 30) through which the second chamber (16) can vent to the headspace whatever the rotational position of the capsule (10).

16. A device according to claim 10, wherein the size of the first aperture (22) is selected so that the force and duration of a gas jet into the liquid when the container (36) is opened will be sufficient to cause the desired head to be produced on the beverage.

17. A device according to claim 16, wherein the sizes of the apertures (26, 28, 30) communicating with the second chamber (16) are selected to determine a preferred time period for the chamber (16) to fill with beverage.

18. A device according to claim 10, wherein the liquid lock is such that the first aperture (22) communicates with the first chamber (14) so that any beverage which enters the first chamber will be prevented from leaving the chamber (14) ahead of the gas trapped therein, when the can is broached.

19. A device according to claim 18, wherein, when the first aperture (22) communicates with the first chamber (14) via a tube (18), the liquid lock is formed by extending the tube (18) into the first chamber (14) to a position in the first chamber remote from the internal division (12) between the first and second chambers, so that when the latter chamber (16) is filled with beverage and the capsule (10) has rotated so that said chamber (16) is lowermost, the open end of the tube (18), extending into the first chamber (14) from the first aperture (22), will be high up in the first chamber (14) and above the level of any beverage which might be forced into the first chamber through the said tube.

20. A device according to claim 10, when located in a sealed and pressurised beverage container (36), and arranged so that the trapped gas is at a higher pressure than atmospheric which, when the container is opened, leaves the capsule (10) through the immersed first aperture (22) which, being immersed, thereby causes the issuing gas to rise and in doing so to pass through the beverage to cause dissolved gases therein to come out of solution and form a head of bubbles on the surface of the beverage in the container.

21. A device according to claim 20, wherein the capsule (10) is maintained free to rotate in the beverage (38) within the container (16) even when submerged, thereby always to maintain the same attitude, whatever the attitude of the container.

22. A device according to claim 18, wherein the capsule (10) is generally cylindrical in shape and in which the apertures (22, 26, 28, 30) are formed in the cylindrical surface and the internal division (12) extends generally axially therein.

23. A device according to claim 18, wherein the capsule (10) is generally spherical in shape.

24. A device according to claim 23 in which the interior of the capsule (10) is divided symmetrically.

* * * * *